US006819901B1

(12) United States Patent
Yasutomi et al.

(10) Patent No.: US 6,819,901 B1
(45) Date of Patent: Nov. 16, 2004

(54) DEVELOPING METHOD AND A DEVELOPING DEVICE FOR IMAGE FORMING APPARATUS

(75) Inventors: Kei Yasutomi, Kanagawa (JP); Tsukuru Kai, Kanagawa (JP); Hisashi Shoji, Kanagawa (JP); Nobutaka Takeuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/708,659

(22) Filed: Nov. 9, 2000

(30) Foreign Application Priority Data

Nov. 9, 1999 (JP) ..... 11-318490

(51) Int. Cl.[7] ..... G03G 15/09
(52) U.S. Cl. ..... 399/277; 399/267
(58) Field of Search ..... 399/53, 265, 267, 399/277, 278

(56) References Cited

U.S. PATENT DOCUMENTS

| | | | | |
|---|---|---|---|---|
| 4,279,498 A | | 7/1981 | Eda et al. | |
| 4,696,255 A | | 9/1987 | Yano et al. | |
| 4,760,422 A | | 7/1988 | Seimiya et al. | |
| 4,911,100 A | * | 3/1990 | Yamashita | 399/277 X |
| 4,930,438 A | | 6/1990 | Demizu et al. | |
| 4,975,748 A | | 12/1990 | Koinuma et al. | |
| 5,044,313 A | * | 9/1991 | Yuge et al. | 399/277 X |
| 5,079,591 A | | 1/1992 | Tomita et al. | |
| 5,109,254 A | | 4/1992 | Oka et al. | |
| 5,202,730 A | * | 4/1993 | Fuji et al. | 399/277 X |
| 5,296,328 A | * | 3/1994 | Fuji et al. | 399/267 X |
| 5,339,141 A | | 8/1994 | Suzuki et al. | |
| 5,341,196 A | | 8/1994 | Hodoshima et al. | |
| 5,359,397 A | | 10/1994 | Yamaji | |
| 5,416,568 A | | 5/1995 | Yoshiki et al. | |
| 5,424,814 A | | 6/1995 | Suzuki et al. | |
| 5,450,177 A | | 9/1995 | Oyama | |
| 5,557,382 A | | 9/1996 | Tatsumi et al. | |
| 5,565,973 A | | 10/1996 | Fujishiro et al. | |
| 5,598,254 A | | 1/1997 | Ikesue et al. | |
| 5,655,193 A | | 8/1997 | Fujishiro et al. | |
| 5,734,953 A | | 3/1998 | Tatsumi | |
| 5,765,079 A | | 6/1998 | Yoshiki et al. | |
| 5,774,772 A | | 6/1998 | Kai et al. | |
| 5,828,935 A | | 10/1998 | Tatsumi et al. | |
| 5,887,224 A | | 3/1999 | Mizuishi et al. | |

(List continued on next page.)

FOREIGN PATENT DOCUMENTS

| | | |
|---|---|---|
| JP | 5-040410 | 2/1993 |
| JP | 05-303284 | 11/1993 |
| JP | 6-194961 | 7/1994 |
| JP | 10-031364 | 2/1998 |

OTHER PUBLICATIONS

Demizu et al., U.S. patent application Ser. No. 06/813,654, filed Dec. 26, 1985.

Demizu et al., U.S. patent application Ser. No. 06/760,404, filed Jul. 30, 1985.

*Primary Examiner*—Sandra L. Brase
(74) *Attorney, Agent, or Firm*—Oblon, Spivak, McClelland, Maier & Neustadt, P.C.

(57) ABSTRACT

An image forming method including providing a developer including a toner and a magnetic carrier, a developer carrier configured to convey the developer deposited thereon, and magnetic field generating means fixed within the developer carrier, and forming a magnetic field which forms a magnet brush between the image carrier and the developer carrier such that the magnet brush rises, contacts the image carrier and collapses within a range in which the magnetic field is more intense than an electric field capable of separating the toner and the magnetic carrier from each other by using the magnetic field generating means. The magnetic brush rubs the image carrier to thereby develop a latent image formed on the image carrier.

29 Claims, 15 Drawing Sheets

U.S. PATENT DOCUMENTS 5,915,143 A 6/1999 Watanabe et al.
5,915,155 A 6/1999 Shoji et al.
5,991,585 A * 11/1999 Nakamura ..... 399/267
6,006,050 A 12/1999 Watanabe et al.
6,055,388 A 4/2000 Watanabe et al.
6,081,684 A 6/2000 Naganuma et al.
6,125,243 A 9/2000 Shoji et al.
6,160,979 A 12/2000 Shoji
6,266,501 B1 7/2001 Mizuishi et al.

* cited by examiner

Fig. 15

| | $\phi$ OVER WHICH BRUSH CONTACTS | NIP WIDTH OF BRUSH | THINNING OF HORIZONTAL LINE | OMISSION OF TRAILING EDGE |
|---|---|---|---|---|
| MR1 | −17~17° | 5.9 mm | × | × |
| MR2 | −15~15° | 5.2 mm | × | × |
| MR3 | −13~13° | 4.5 mm | × | × |
| MR4 | −14~14° | 4.9 mm | △ | △ |
| MR5 | −12~12° | 4.2 mm | △ | △ |
| MR6 | −10~10° | 3.5 mm | △ | △ |
| MR7 | −10~10° | 3.5 mm | △ | △ |
| MR8 | −9~9° | 3.1 mm | ○ | ○ |
| MR9 | −9~9° | 3.1 mm | ○ | ○ |

Fig. 16

| MAIN POLE ANGLE | 0° | | 5° | | 10° | |
|---|---|---|---|---|---|---|
| | THINNING & OMISSION | SOLID ID | THINNING & OMISSION | SOLID ID | THINNING & OMISSION | SOLID ID |
| MR1 | × | 1.44 | × | 1.43 | △ | 1.40 |
| MR2 | × | 1.44 | × | 1.41 | △ | 1.38 |
| MR3 | × | 1.42 | △ | 1.40 | △ | 1.38 |
| MR4 | △ | 1.44 | △ | 1.42 | ○ | 1.38 |
| MR5 | △ | 1.44 | △ | 1.41 | ○ | 1.36 |
| MR6 | △ | 1.43 | ○ | 1.40 | ○ | 1.35 |
| MR7 | △ | 1.44 | ○ | 1.41 | ○ | 1.34 |
| MR8 | ○ | 1.44 | ○ | 1.40 | ○ | 1.31 |
| MR9 | ○ | 1.44 | ○ | 1.38 | ○ | 1.30 |

| | C=A/B | SOLID ID |
|---|---|---|
| DEVELOPER 1 | 10 | 1.44 |
| DEVELOPER 2 | 7 | 1.44 |
| DEVELOPER 3 | 6 | 1.43 |

Fig. 24

| BACKGROUND POTENTIAL (Vd−Vb) | THINNING OF HORIZONTAL LINE | OMISSION OF TRAILING EDGE | BACKGROUND CONTAMINATION |
|---|---|---|---|
| 300 | ○ | ○ | ○ |
| 200 | ○ | ○ | ○ |
| 100 | ○ | ○ | △ |
| 50 | ○ | ○ | × |

Fig. 25

| Gd | ϕ OVER WHICH BRUSH CONTACTS | THINNING OF HORIZONTAL LINE | OMISSION OF TRAILING EDGE | SOLILARY DOTS (HIGHLIGHT) | DEVELOPING ABILITY (SOLID ID) |
|---|---|---|---|---|---|
| 0.4mm | −9~9° | ○ | ○ | ○ | 1.44 |
| 0.3mm | −9~9° | ○ | ○ | Δ~× | 1.40 |
| 0.2mm | −9~9° | ○ | ○ | × | 1.40 |

Fig. 26

| SATURATION MAGNETIZATION | ϕ OVER WHICH BRUSH CONTACTS | THINNING OF HORIZONTAL LINE | OMISSION OF TRAILING EDGE | CARRIER DEPOSITION |
|---|---|---|---|---|
| 80 emu/g | −9~9° | ○ | ○ | ○ |
| 60 emu/g | −9~9° | ○ | ○ | ○ |
| 40 emu/g | −8~8° | ○ | ○ | ○ |
| 30 emu/g | −7~7° | ○ | ○ | × |

DEVELOPING METHOD AND A DEVELOPING DEVICE FOR IMAGE FORMING APPARATUS

BACKGROUND OF THE INVENTION

The present invention relates to an image forming method for developing a latent image by use of a magnetic force and an apparatus therefor.

In a copier, printer, facsimile apparatus or similar electrophotographic or electrostatic image forming apparatus, a latent image is formed on an image carrier in accordance with image data. The image carrier is implemented as a photoconductive drum or belt by way of example. A developing unit develops the latent image with toner to thereby form a corresponding toner image.

The developing unit uses either one of a one-ingredient type developer, or toner, and a two-ingredient type developer or toner and magnetic carrier mixture. The two-ingredient type developer allows the charge of the toner to be controlled more easily than the one-ingredient type developer and causes a minimum of-cohesion to occur in the toner. With the two-ingredient type developer therefore, it is possible to execute effective control over the migration of the toner by using, e.g., a bias electric field. Further, the toner of this type of developer does not have to contain a magnetic material or contains only a minimum amount of magnetic material for obviating blurring. Therefore, a color toner in particular insures a clear color. Moreover, in the case of a magnet brush developing method that causes a developer layer to rub the surface of an image carrier, a magnet brush easily rises and desirably rubs itself against the above surface. The two-ingredient type of developer with such advantages is often used despite that the toner content of the developer must be controlled.

However, a problem with the developing unit using the two-ingredient type developer is that a single-dot line formed in the direction perpendicular to the direction of paper conveyance becomes thinner than a single-dot line formed in the direction of paper conveyance. This phenomenon will be referred to as the thinning of a horizontal line hereinafter. Another problem is that the trailing edge of, e.g., a halftone image is lowered in density or not developed at all. Let this phenomenon be referred to as the omission of a trailing edge hereinafter. To solve these problems, there has been proposed to position the main pole angle of a magnet roller at an upstream side or to set up a preselected relation between the distance between a doctor blade and a developing sleeve and the distance between a photoconductive drum and the developing sleeve, as taught in, e.g., Japanese Patent Laid-Open Publication No. 7-140730. The prerequisites with this kind of scheme are as follows:

(1) The main pole for development is positioned in a range of from 5° to 20° upstream of a position where the developing sleeve and photoconductive drum are closest to each other in a direction of developer conveyance (closest position hereinafter);

(2) The doctor blade and developer carrier are spaced by a distance (Hcut) of 0.25 mm to 0.75 mm;

(3) A nip for development extends over 0.30 mm to 0.80 mm (Dsd);

(4) A ratio Dsd/Hcut is greater than 1.20, but smaller than 1.60; and (5) A ratio of the moving speed Vs of the developer carrier to the moving speed Vp of the image carrier (Vs/Vp) is greater than or equal to 1.0, but smaller than or equal to 3.0.

It is generally accepted that if the above conditions (1) through (5) are satisfied, a toner layer is protected from disturbance in halftone and solid portions when the apparatus is operated in a high-speed range. This allows a clear-cut image to be produced without any breakage of thin lines and with high and uniform density.

There is a keen demand for an improvement in the developing ability of the apparatus using the two-ingredient type developer. In this respect, Japanese Patent Publication No. 2-59995, for example, proposes to position a magnetic pole adjoining the main pole closer to the main pole. This document teaches that such a position of the magnetic pole lowers the density of horizontal lines, i.e., the thinning of a horizontal line, but the lower density can be coped with if the saturation magnetization of the carrier is lowered to weaken the magnet brush. Japanese Patent Laid-Open Publication No. 6-149063 discloses a non-contact type developing device using the two-ingredient type developer and having a pole arrangement that maintains a magnet brush spaced from a photoconductive element. The prerequisites with this pole arrangement are as follows:

(1) A developing position is defined between a pair of N and S poles;

(2) The angle between the N and S poles is between 40° and 70° while each flux density is 500 or above; and (3) A magnet angle between a point where an image forming body and a magnet brush roll are closest to each other and the center between the poles is between 0° and one-tenth of the above angle between the N and S poles, and the developing position is between the poles of the magnet.

The document describes that if the above conditions (1) through (3) are satisfied, a stable, high quality image is achievable with a minimum of blurring ascribable to the deposition of the carrier on the image forming body and a minimum of omission of an image around portions where the carrier is deposited.

In accordance with the above-described Laid-Open Publication No. 7-140730, the ratio Dsd/Hcut is confined in the range of $1.2<Dsd/Hcut<1.6$. The problem with this scheme is that as the ratio Dsd/Hcut increases from 1, i.e., as Hcut decreases relative to Dsd, the magnet brush decreases in density in the closest position of the developing sleeve and photoconductive element. As a result, the magnet brush fails to uniformly contact the photoconductive element and cannot rub the entire surface of the element. This leads to an occurrence that part of solitary dots forming an image (e.g. dots sized 600 dpi (dots per inch) and spaced from each other by five to ten pixels) is reduced in size or practically omitted. When solitary dots are not uniformly reproduced, the reproducibility and tonality of a high contrast portion are deteriorated. Further, a halftone image whose density is about 0.3 to about 0.8 (ID) appears granular due to the non-uniform contact of the magnet brush.

The scheme taught in Publication No. 2-59995 mentioned earlier has a drawback that when the saturation magnetization of the carrier is lowered, so-called carrier deposition is aggravated. When the amount of charge to deposit on the toner is reduced in order to obviate carrier deposition, the amount of uncharged toner increases and brings about background contamination.

The implementation taught in Laid-Open Publication No. 6-149063 also mentioned earlier has a problem that the electric field for development is weak due to non-contact development, making it difficult to improve the developing ability.

By a series of experiments, we found that the thinning of a horizontal line and the omission of a trailing edge were presumably ascribable to the same cause. As the developer on the developing sleeve approaches the closest position of the sleeve and photoconductive element, it forms the magnet brush and is smashed by the sleeve and the element. In a conventional image forming apparatus, the magnet brush is again formed after it has moved away from the above closest position (downstream of the closest position) and is again caused to contact the photoconductive element. This magnet brush is formed by the magnetic field around the skirt of the main pole, i.e., the pole for development. On the other hand, when the magnet brush faces the background or white portion of the photoconductive element, toner in the magnet brush is biased toward the developing sleeve by a magnetic field corresponding to the background potential. As a result, the toner density at the tip of the magnet brush is lowered. For the development using the toner and magnetic carrier mixture, the developing sleeve is rotated at a peripheral speed 1.5 times to 2.5 times as high as the peripheral speed of the photoconductive element. Consequently, the magnet brush whose toner density is lowered at the tip contacts the trailing edge and single dot, horizontal lines of an image.

So long as the magnet brush mentioned above contacts the photoconductive element at the closest position of the element and developing sleeve, the toner deposited on the photoconductive element does not return to the magnet brush. This is presumably because the electric field is most intense at the closest position and allows even the toner biased toward the developing sleeve to contribute to development. By contrast, assume that the magnet brush whose toner density is lowered at the tip, as stated above, contacts the photoconductive element at the side downstream of the closest position. Then, because the electric field at such a position is weaker than at the closest position, part of the toner deposited on the photoconductive element returns to the magnet brush. In the region downstream of the closest position where the distance between the developing sleeve and the photoconductive element sequentially increases, the force tending to separate the toner of the magnet brush from the carrier and cause it to deposit on the photoconductive element sequentially decreases. As the above distance further increases, it becomes practically impossible to separate the toner from the carrier. This, coupled with the previously stated cause, causes the toner deposited on the closest position of the photoconductive element to return to the magnet brush. This reduces the amount of toner to deposit on horizontal lines and the trailing edge of an image, resulting in the thinning of a horizontal line and the omission of a trailing edge.

The present invention prevents the toner from returning from the photoconductive element to the magnet brush. Specifically, in accordance with the present invention, an electric field formed between the photoconductive element and the developing sleeve causes the magnet brush to fall or collapse (not contacting the photoconductive element) within a range in which the electric field is more intense than one capable of separating the toner and carrier from each other. Therefore, even if the toner deposited on the photoconductive element returns to the magnet brush at the side downstream portion of the developing region, the present invention makes up for the return with the toner existing in the magnet brush. This is because the electric field between the photoconductive element and the developing sleeve in the above range is more intense than one capable of separating the toner and carrier from each other. The present invention therefore obviates the thinning of a horizontal line and the omission of a trailing edge.

Further, in accordance with the present invention, an electric field formed between the photoconductive element and the developing sleeve causes the magnet brush to rise within a range in which the electric field is more intense than one capable of separating the toner and carrier from each other. In this condition, the toner in the magnet brush easily moves and insures a high developing ability. More specifically, at a position where the magnet brush collapses, the developer is packed and therefore dense to thereby prevent the toner existing therein from sharply responding to the electric field. By contrast, the present invention promotes the easy movement of the toner and maintains the developing ability relatively high. It was experimentally found that when the magnet brush rose at a position close to the closest position, a high developing ability was achieved.

In the developing region, the electric field formed between the photoconductive element and the developing sleeve causes the magnet brush to rise or fall only within the range in which the electric field is more intense than one capable of separating the toner and carrier from each other. Therefore, even if the toner deposited on the photoconductive element returns to the magnet brush at the side downstream portion of the developing region, the present invention makes up for the return with the toner existing in the magnet brush. The present invention therefore obviates the thinning of a horizontal line and the omission of a trailing edge. Further, even at the upstream side of the developing region, the range over which the magnet brush contacts the photoconductive element is limited, the toner in the magnet brush is prevented from depositing on the photoconductive element without regard to the electric field, obviating background contamination. Because the magnet brush falls only within the above particular range, the present invention is practicable even when the half center angle of the magnet roller cannot be reduced due to limitations on the magnet roller, e.g., because of a limited space available for the magnet roller.

Technologies relating to the present invention are also in disclosed in, e.g., Japanese Patent Laid-Open Publication No. 5-303284.

SUMMARY OF THE INVENTION

It is therefore an object of the present invention to provide an image forming method capable of obviating the thinning of a horizontal line and the omission of a trailing edge, the omission of solitary dots and the granularity of a halftone image ascribable to the irregular contact of a magnet brush, and the carrier deposition and therefore maintaining a high developing ability, and an apparatus for practicing the same.

In accordance with the present invention, in an image forming method using a magnet filed generating device fixed in place within a developer carrier, which conveys a developer consisting of toner and magnetic carrier and deposited thereon, for forming a magnet brush on the developer carrier, the magnet brush rubbing an image carrier to thereby develop a latent image formed on the image carrier, a magnetic field that causes the magnet brush to rise, contact the image carrier and then fall is formed between the image carrier and the developer carrier within a range in which the magnetic field is more intense than an electric field capable of separating the toner and carrier from each other.

Also, in accordance with the present invention, an image forming apparatus includes an image carrier, a developer carrier for conveying a developer consisting of toner and magnetic carrier and deposited thereon, and a magnetic field generating device fixed in place within the developer carrier and configured to form a magnetic field that forms a magnet brush on the developer carrier and causes the magnet brush to rub the image carrier for thereby developing a latent image formed on the image carrier. The magnetic field, which causes the magnet brush to rise, contact the image carrier and then fall, is formed between the image carrier and the developer carrier within a range in which the magnetic field is more intense than an electric field capable of separating the toner and carrier from each other.

BRIEF DESCRIPTION OF THE DRAWINGS

The above and other objects, features and advantages of the present invention will become more apparent from the following detailed description taken with the accompanying drawings in which:

FIG. 15 is a table showing the center angles $\phi$ of the magnet rollers MR1 through MR9 and the results of estimation of images;

FIG. 16 is a table showing the main pole angles of the magnet rollers MR1 through MR9 and the results of estimation of images;

FIG. 24 is a table showing a relation between background potentials and the results of estimation particular to a fifth embodiment of the present invention;

FIG. 25 is a table showing a relation between distances between a developing sleeve and a doctor blade included in a sixth embodiment of the present invention and the results of estimation; and FIG. 26 is a table showing a relation between the saturation magnetizations of a magnetic carrier and the results of estimation.

DESCRIPTION OF THE PREFERRED EMBODIMENTS

Figure 1:
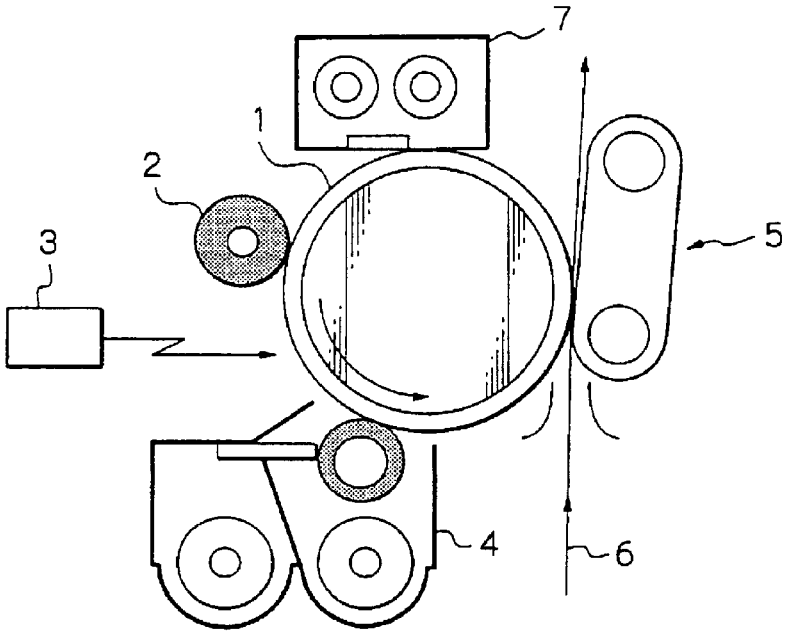
Fig. 1 PRIOR ART
FIG. 1 is a view showing an image forming apparatus whose mechanical structure is known in the art and relates to the present invention also.

To better understand the present invention, brief reference will be made to a conventional image forming apparatus, shown in FIG. 1. As shown, the image forming apparatus includes a photoconductive drum or image carrier rotatable in a direction indicated by an arrow (counterclockwise). A charger 2 uniformly charges the surface of the drum 1. An exposing unit 3 exposes the charged surface of the drum 1 imagewise so as to form a latent image. A developing unit 4 develops the latent image to thereby form a corresponding toner image. The developing unit 4 includes a casing and a developing sleeve or developer carrier. An image transfer unit 5 transfers the toner image from the drum 1 to a paper sheet or similar recording medium 6. A fixing unit, not shown, fixes the toner image on the paper sheet 6. A cleaning unit 7 removes toner left on the drum 1 after the image transfer. Subsequently, a discharger, not shown, discharges the surface of the drum 1 for thereby preparing the drum 1 for the next image formation. The developing unit 4 stores a two-ingredient type developer, i.e., a toner and magnetic carrier mixture.

Figure 2:
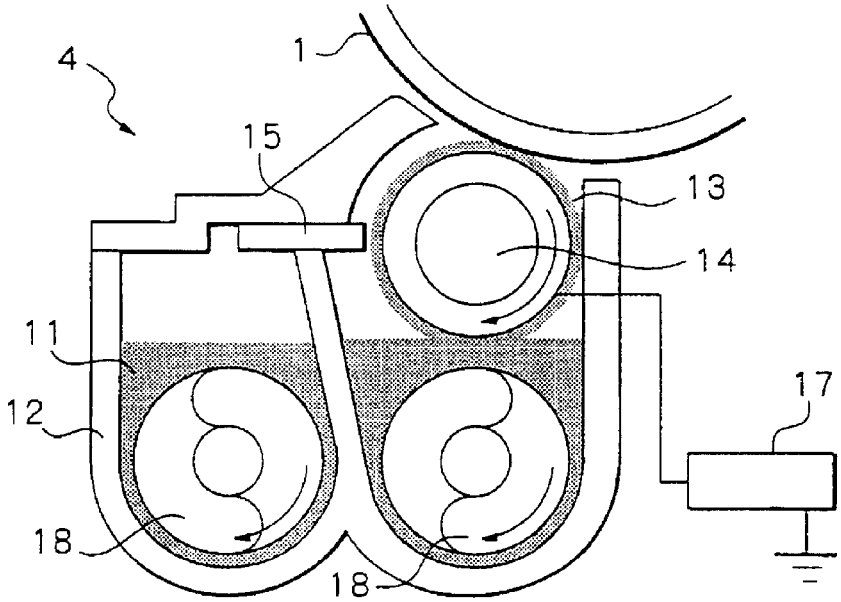
Fig. 2 PRIOR ART
FIG. 2 is a view showing a developing unit included in the apparatus of FIG. 1 and relating to the present invention also.

FIG. 2 shows the developing unit 4 in detail. As shown, the developing unit 4 includes a casing 12 storing a two-ingredient type developer 11. A developing sleeve 13 is disposed in the casing 12 such that it faces the drum 1 through an opening formed in the casing 12. A drive source, not shown, causes the developing sleeve 13 to rotate in a direction indicated by an arrow (clockwise). A magnet roller 14 with N and S magnetic poles is accommodated in developing sleeve 13 and fixed in place to serve as a magnetic field generating device. A doctor blade or regulating member 15 faces, but does not contact, the developing sleeve 13 for regulating the height of a magnet brush formed on the sleeve 13.

In operation, the developing sleeve 13 in rotation conveys the developer 11 deposited thereon in the form of a magnet brush while the doctor blade 15 regulates the height of the magnet brush. The developing sleeve 13 conveys the regulated developer 11 to a developing region where the sleeve 13 faces, but does not contact, the drum 1. A power source 17 applies a DC voltage to the developing sleeve 13 with the result that an electric field corresponding to the latent image formed on the drum 1 is formed between the drum 1 and the sleeve 13. Consequently, toner contained in the developer and charged beforehand is transferred from the developing sleeve 13 to the drum 1 by the above electric field, developing the latent image.

A pair of parallel screws 18 are also disposed in the casing 12. A drive source, not shown, causes the screws 18 to rotate in such a manner as to convey the developer 11 in opposite directions to each other while agitating it. The screws 18 therefore maintain the toner content of the developer 11 constant even when fresh toner is replenished to the casing 12 from a toner container not shown.

However, the conventional image forming apparatus described above has some problems left unsolved, as stated earlier.

Preferred embodiments of the image forming method and apparatus therefor in accordance with the present invention will be described hereinafter.

First Embodiment

While a first embodiment of the present invention is basically identical in mechanical arrangement with the conventional image forming apparatus, the mechanical arrangement will be described again.

Referring again to FIG. 1, the drum 1 is implemented by a conductor whose surface is coated with a photoconductive material. The drum 1 rotates in the previously mentioned direction at a peripheral speed of, e.g., 230 mm/sec. The charger 2 is made up of a roller contacting the drum 1 and a power source for applying a voltage to the roller. The charger 2 uniformly charges the surface of the drum 1 to a desired potential, e.g., −0.6 kV. The exposing unit 3 includes a light source implemented by, e.g., a laser diode not shown. The exposing unit 3 scans the charged surface of the drum 1 with a laser beam in accordance with image data via a polygonal mirror, not shown, thereby electrostatically forming a latent image. The developing unit 4 develops the latent image with the developer to thereby form a corresponding toner image. The image transfer unit 5 transfers the toner image from the drum 1 to the paper sheet 6, which is conveyed at a preselected timing by a conveyor not shown. The fixing unit, not shown, fixes the toner image on the paper sheet 6. The cleaning unit 7 cleans the surface of the drum 1 after the image transfer. The discharger, not shown, dissipates potential left on the drum 1 so as to prepare the drum 1 for the next image formation.

The developing unit 4 is basically made up of the developing sleeve or developer carrier, developer containing a magnetic carrier, and power source. The power source applies a voltage of, e.g., −0.4 kV to the developing sleeve. As a result, the exposed portions of the drum 1 are developed by the toner, forming a toner image (so-called reversal development). In an image transfer unit using an endless belt, for example, the power source applies a voltage to the belt (e.g. constant current control; 30 $\mu$A) in order to transfer the toner image to a paper sheet. In the illustrative embodiment, the background potential or charge potential of the drum 1 (particularly a difference between the potential Vd of a non-image portion and a bias Vb for development) is selected to be 200 V. Such a background potential allows an electric field to be formed in such a manner as to cause a minimum of toner to deposit on the background of an image. Stated another way, by increasing the background potential, it is possible to reduce background contamination.

While the developing unit, which is the major unit for practicing the method of the illustrative embodiment, is also basically identical in mechanical arrangement with the conventional one, let the mechanical arrangement be described again with reference to FIG. 2. It should be noted that while the developing unit of the illustrative embodiment is one of developing units using a two-ingredient type developer well known in the art, the present invention is, of course, practicable with any developing unit other than the unit of FIG. 2 so long as it uses a two-ingredient type developer.

In FIG. 2, the casing 12 stores the two-ingredient type developer 11. The developing sleeve 13 is disposed in the casing 12 such that it faces the drum 1 through the opening formed in the casing 12. The drive source, not shown, causes the developing sleeve 13 to rotate in a direction indicated by an arrow (clockwise). The developing sleeve 13 is formed of, e.g., aluminum and has a diameter of 20 mm, a length of 320 mm, and a thickness of 0.7 mm. Axial grooves, which are 0.2 mm deep by way of example, are formed in the surface of the developing sleeve 13 at the intervals of 1 mm in the circumferential direction of the sleeve 13. The developing sleeve 13 rotates at a peripheral speed of 460 mm/sec, which is two times as high as the peripheral speed of the drum 1.

Toner contained in the developer 11 is nonmagnetic toner having a mean particle size of 5.0 $\mu$m and chargeable to negative polarity. The carrier also contained in the developer 11 is a magnetic carrier having a mean particle size of 35 $\mu$m and a saturation magnetization of 60 em$\mu$/g. Each carrier particle is covered with a surface layer such that the amount of charge Q/m to deposit on the toner is −15 $\mu$C/g. The casing 12 stores, e.g., 500 g of developer whose toner content is 5 wt %. The screws 18 disposed in the casing 12 each have of diameter of 19 mm and a pitch of 20 mm and rotated by the drive source, not shown, at a speed of 550 rpm. The screws 18 convey the developer 11 in opposite directions to each other, as stated earlier, so that the developer 11 is evenly circulated in the casing 12. While the toner and carrier of the developer are agitated by the screws 18, friction acting between the toner and the carrier charges the toner. The screws 18, so conveying and agitating the developer 11, maintains the toner content of the developer 11 constant even when fresh toner is replenished from the toner container not shown.

The power source 17 applies a bias for development, e.g., DC −0.4 kV to the developing sleeve 13. The developing sleeve 13 in rotation conveys the developer 11 deposited thereon in the form of a magnet brush while the doctor blade 15 regulates the height of the magnet brush. The developing sleeve 13 conveys the regulated developer 11 to the developing region where the sleeve 13 faces, but does not contact, the drum 1. The voltage applied to the developing sleeve 13 forms an electric field corresponding to the latent image formed on the drum 1 between the drum 1 and the sleeve 13. Consequently, the charged toner is transferred from the developing sleeve 13 to the drum 1 by the above electric field. In the illustrative embodiment, the latent image formed on the drum 1 has a potential of −0.6 kV in a non-image portion and an about −0.1 kV in an image portion.

Figure 3:
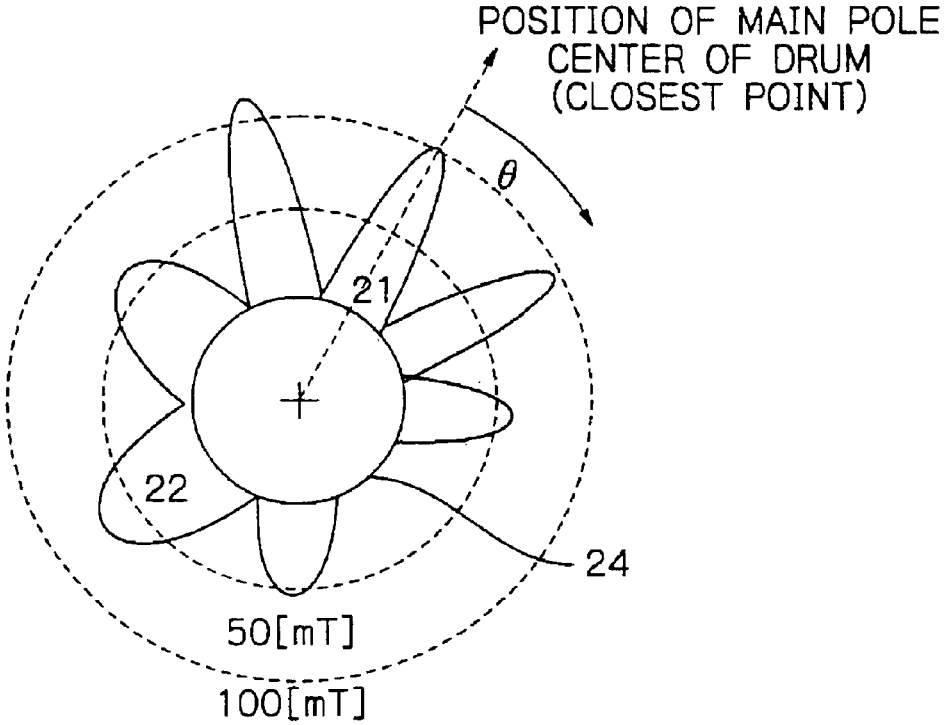
FIG. 3 is a view showing a flux density distribution particular to a magnet roller included in a first embodiment of the present invention.
Figure 4:
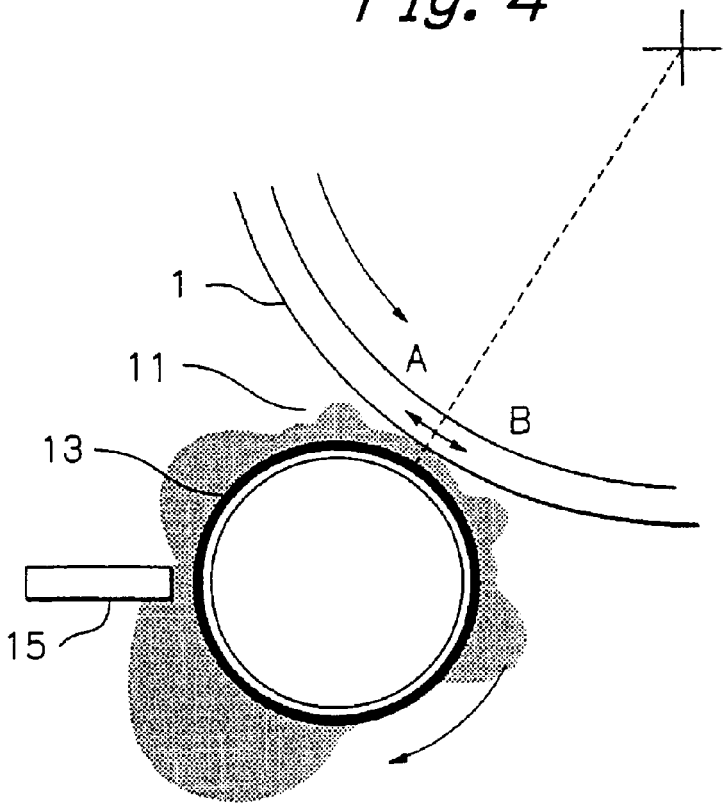
FIG. 4 is a view showing how a magnet brush contacts a photoconductive element in a developing unit included in the first embodiment.

FIG. 3 shows how the magnet roller or magnetic field generating means 14 is magnetized. As shown, a main pole 21 is directed toward a point where the drum 1 and developing sleeve 13 are closest to each other (closest point hereinafter), as seen from the center of the magnet roller 14. The main pole 21 has a flux density of 90 mT (millitesla) to 100 mT and a so-called half center angle of 20°. While a conventional magnet roller has a single developing magnetic pole, the magnetic roller 14 of the illustrative embodiment has magnetic poles at both sides of the main pole 21 in order to reduce the half center angle. The above flux density refers to the component of a flux density, as measured on the surface of the developing sleeve 13, that is directed toward the center of the magnet roller 14. A scooping magnetic pole 22 has a flux density of 70 mT. The flux density is 10 mT or below at a portion 24 that causes the developer to part from the developing sleeve 13.

As shown in FIG. 2, the doctor blade 15 is a 1.6 mm thick plate formed of SUS prescribed by JIS (Japanese Industrial Standards) and spaced from the developing speed by a gap of 0.4 mm. A gap between the developing sleeve 13 and the drum 1, as measured at the opening of the casing 12, FIG. 2, is also 0.4 mm.

Figure 5:
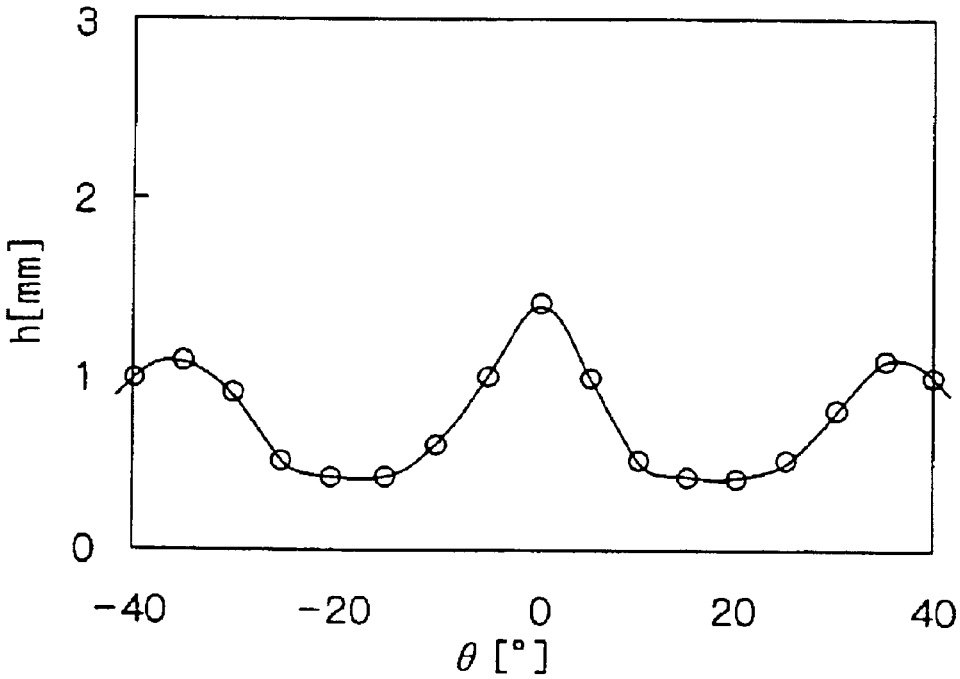
FIG. 5 is a graph showing the height distribution of the magnet brush available with the first embodiment.

FIG. 5 plots the distribution of heights of the magnet brush formed on the developing sleeve 13 by the magnet roller 14. In FIG. 5, the ordinate and abscissa respectively indicate the height of the magnet brush and the position on the developing sleeve 13. The center angle θ of the magnet roller 14, which indicates a position on the surface of the developing sleeve 13, is assumed to be 0° at the position of the main pole 21; the direction indicated by the arrow in FIG. 3 is assumed to be a forward direction. That is, the position where the center angle θ is 0° corresponds to the closest point of the drum 1 and developing sleeve 13. To measure the height of the magnet brush, a height gauge was caused to contact the magnet brush being rotated.

Figure 6:
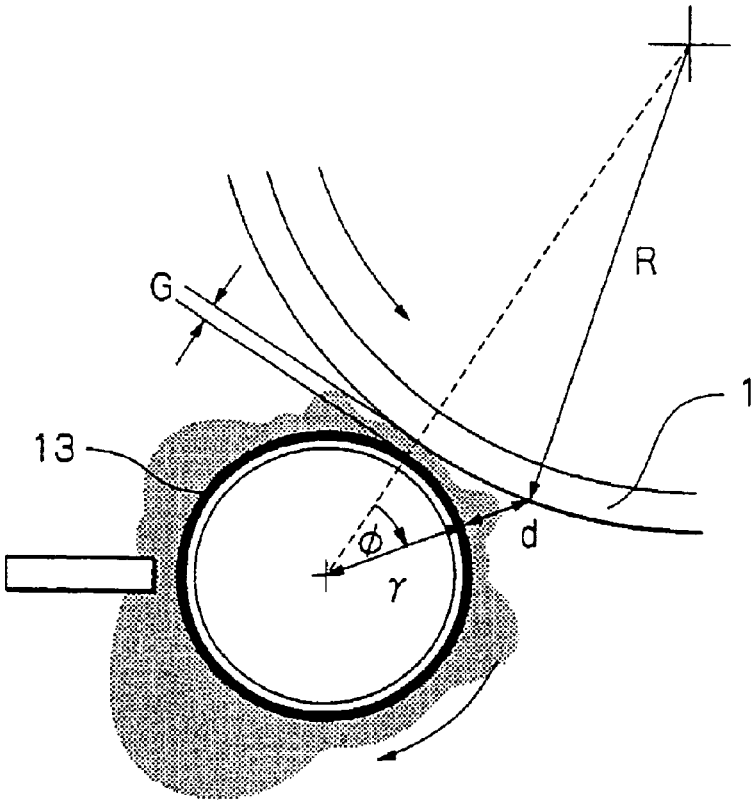
FIG. 6 is a view useful for understanding the center angle $\phi$ of the magnet brush included in the first embodiment.

On the other hand, assume the center angle ϕ of the magnet roller 14 whose reference is the point where the magnet roller 14 is closest to the drum 1. Then, as FIG. 6 indicates, a distance d from the surface of the developing sleeve 13 to that of the drum 1 is expressed as:

$$d=(R+r+G)\cdot\sin\phi-(R^2+(R+r+G)^2\cos^2\phi)^{1/2}-r$$

where R denotes the radius of the drum 1, r denotes the radius of the developing sleeve 13, and G denotes a gap between the drum 1 and the sleeve 13.

Figure 7:
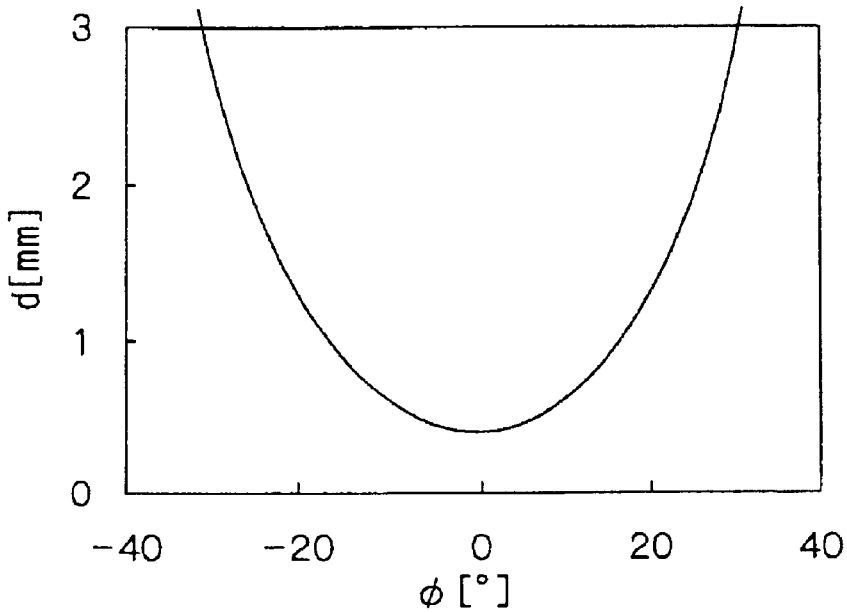
FIG. 7 is a graph showing a relation between the distance between a developing sleeve and a photoconductive element included in the first embodiment and the center angle $\phi$.

FIG. 7 shows distances d calculated on the assumption that R, r and G were 30 mm, 10 mm and 0.4 mm, respectively.

Figure 8:
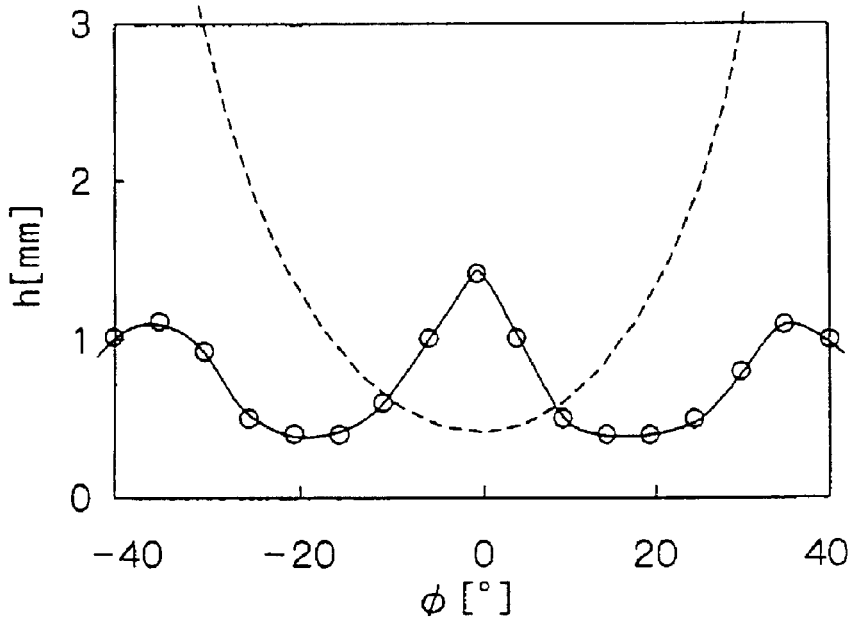
FIG. 8 is a graph demonstrating the contact condition of the magnet brush particular to the first embodiment.

In the illustrative embodiment, the main pole of the magnet roller 14 is positioned at the closest point, so that the angles θ and ϕ are equal to each other. FIG. 8 compares, based on the relation of θ=ϕ, the heights of the magnet brush actually measured and the distances d from the surface of the developing sleeve 13 to that of the drum 1 calculated in terms of the center angle ϕ. In FIG. 8, a dotted curve and a solid curve indicate the distances d and the heights of the magnet brush, respectively. The portions of the solid curve appearing below the dotted curve indicate that the magnet brush does not contact the drum 1. It will be seen that in the above-described configuration the magnet brush contacts the drum 1 only around the closest point over about 3 mm.

In the illustrative embodiment, the magnet roller 14 may be replaced with any other suitable magnetic field generating means of may have the main pole located at any other suitable position. For comparison, the following nine different kinds of magnet rollers (MR hereinafter) each having a diameter of 20 mm were prepared in order to measure the height of the magnet brush:

MR1: main pole half center angle of 50° magnetic flux peak of 120 mT

MR2: main pole half center angle of 50° magnetic flux peak of 90 mT

MR3: main pole half center angle of 50° magnetic flux peak of 60 mT

MR4: main pole half center angle of 35° magnetic flux peak of 120 mT

MR5: main pole half center angle of 35° magnetic flux peak of 90 mT

MR6: main pole half center angle of 35° magnetic flux peak of 60 mT

MR7: main pole half center angle of 20° magnetic flux peak of 120 mT

MR8: main pole half center angle of 20° magnetic flux peak of 90 mT (illustrative embodiment)

MR9: main pole half center angle of 20° magnetic flux peak of 60 mT

Figure 9:
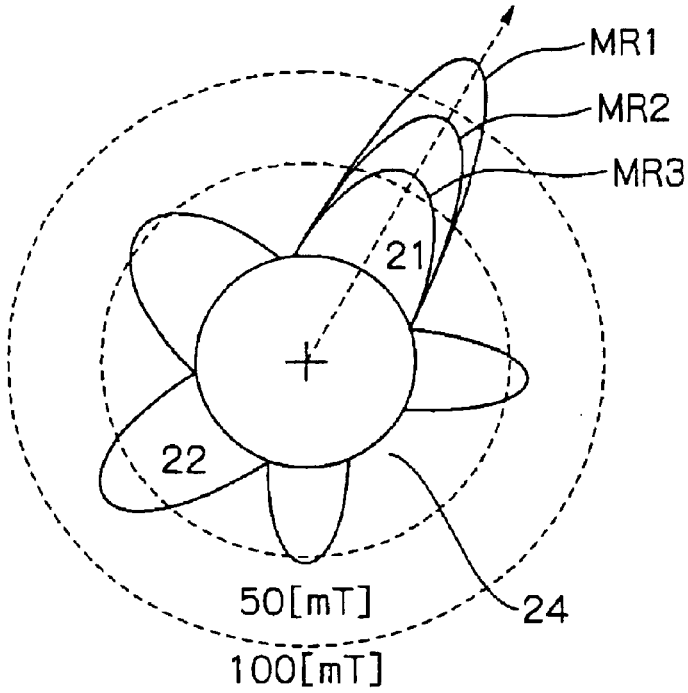
FIGS. 9, 10 and 11 are views respectively showing the flux density distributions of magnet rollers MR1 through MR3, magnet rollers MR4 through MR6, and magnet rollers MR7 through MR9.
Figure 10:
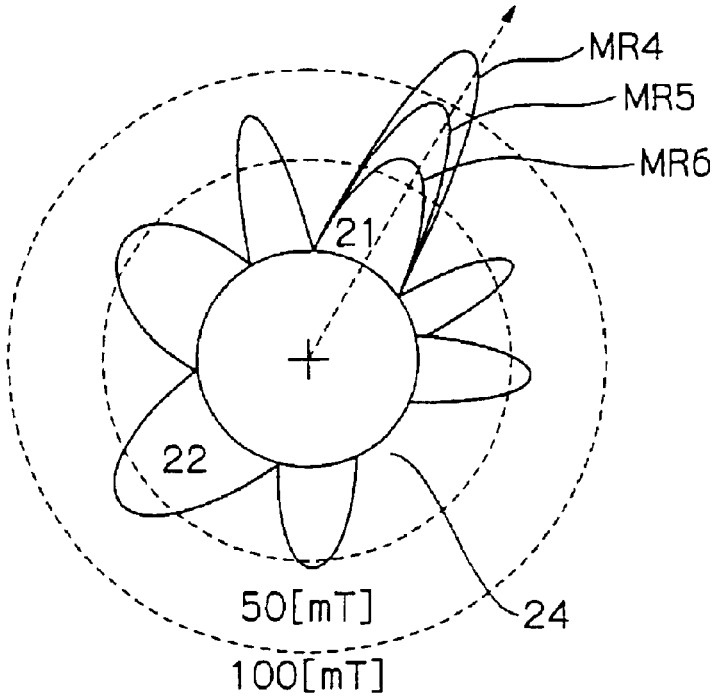
Figure 11:
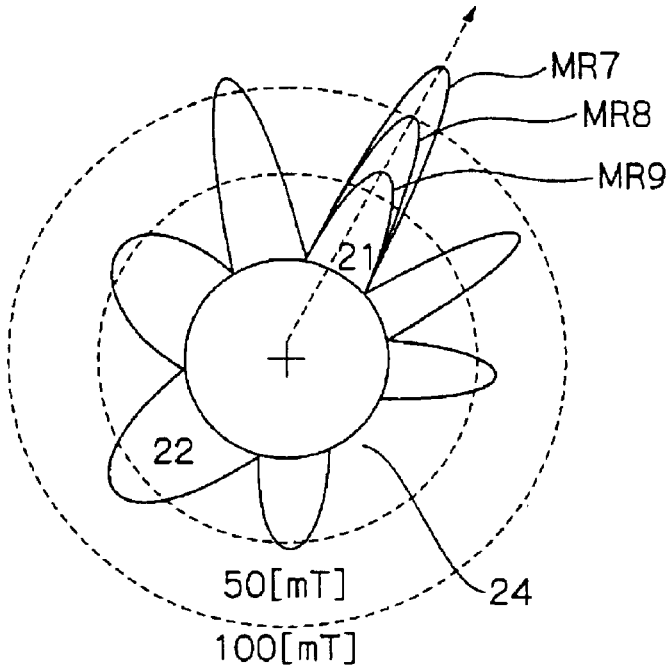
Figure 12:
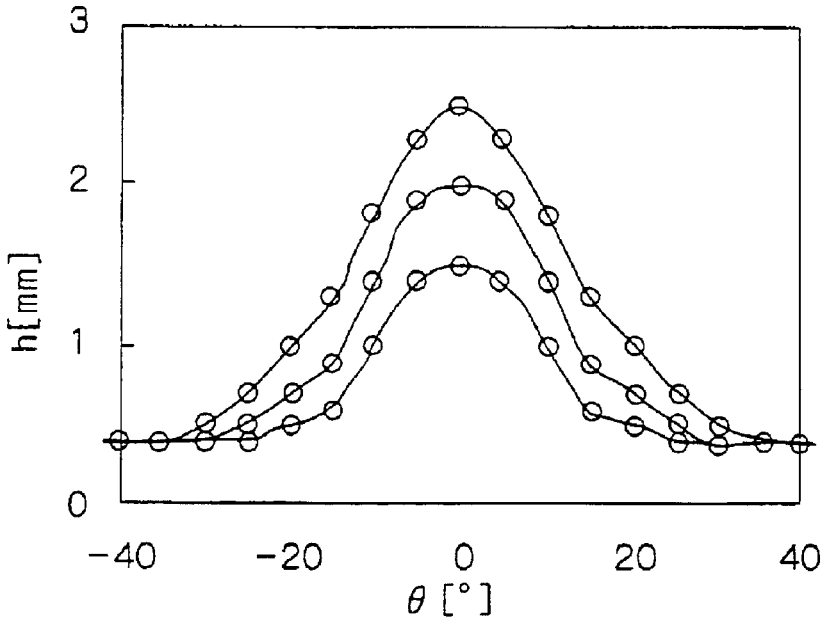
FIGS. 12, 13 and 14 are graphs respectively showing the height distributions of magnet brushes formed on the magnet rollers MR1 through MR3, magnet rollers MR4 through MR6, and magnet rollers MR7 through MR9.
Figure 13:
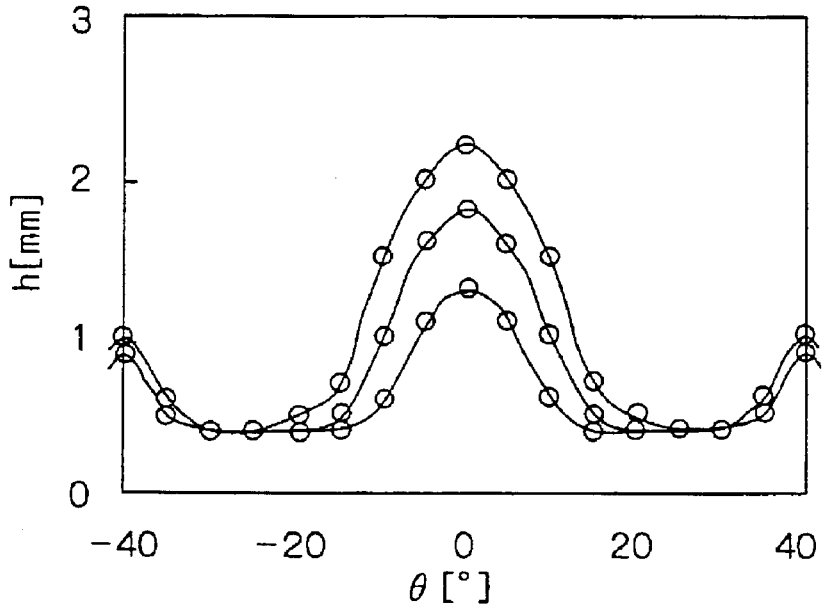
Figure 14:
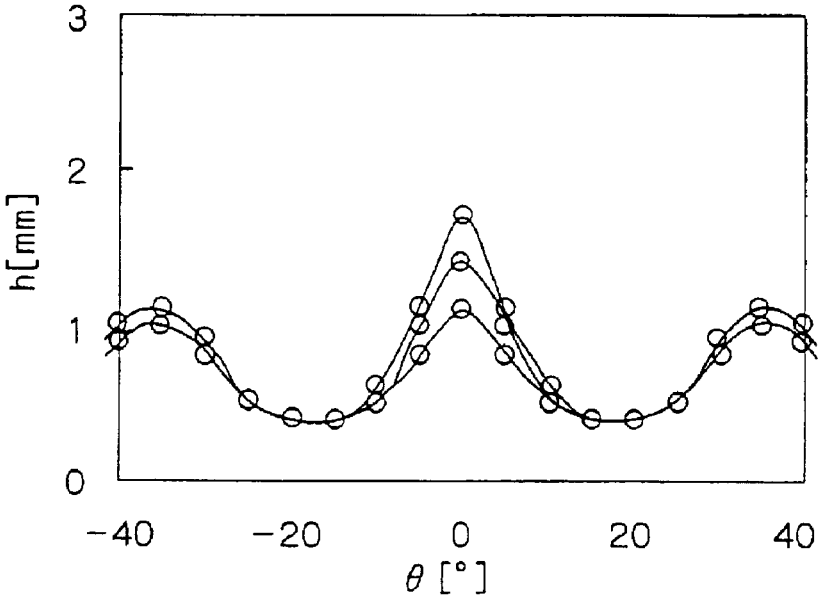

FIGS. 9 through 11 show the flux densities of the above magnet rollers MR1 through MR9. As for the magnet rollers whose half center angles are 35° and 20°, auxiliary magnetic poles are formed at both sides of the main pole. The flux density indicates the component of a flux density, which is measured on the surface of the developing sleeve 13, that is directed toward the center of the magnet roller 14. FIGS. 12 through 14 plots the heights of magnet brushes measured on the developing sleeves to which the magnet rollers MR1 through MR9 were assigned (see FIG. 3 for the angle θ and direction).

FIG. 15 shows the ranges of magnet roller center angles ϕ over which the magnet brushes formed by the magnet rollers MR1 through MR9 contacted the drum 1. More specifically, FIG. 15 lists the results of estimation as to the thinning of a horizontal line and the omission of a trailing edge. The results shown in FIG. 15 were determined when images were formed with the main pole of each magnet roller aligned with the closest point.

In FIG. 15, circles, triangles and crosses are representative of the results of estimation as to a single dot, horizontal line and the omission of a trailing edge. Criteria used for the estimation are as follows.

As for single-dot lines, an image consisting of single dot, horizontal and vertical lines (600 dpi) was formed and then transferred to a recording medium to observe its density and widths by eye. The background potential was varied in the range of from 50 V to 300 V, i.e., the charge potential was varied in the range of from −900 V to −650 V with the bias for development being fixed at −600 V. A circle shows that the vertical and horizontal lines were the same without regard to the background potential. A triangle shows that the horizontal and vertical lines were different from each other when the background potential was 100 V or above, but were the same as each other when it was lower than 100 V. A cross shows that the horizontal and vertical lines were different from each other even when the background potential was lower than 100 V.

As for the omission of a trailing edge, a dot image (600 dpi and sized 1 $cm^2$) was formed and then transferred to a recording medium. Again, the background potential was varied in the range of from 50 V to 300 V in order to estimate how the trailing edge of the image decreased in density. A circle, a triangle and a cross are identical in meaning with the circle, triangle and cross described in relation to the estimation of single-dot lines.

As FIG. 15 indicates, desirable results as to the difference between horizontal and vertical lines and the omission of a trailing edge are achievable so long as the magnet brush contacts the drum 1 within the range of ϕ=±θ°, which corresponds to a nip width of 3.1 mm in the illustrative embodiment.

Further, the angle of the main pole formed on each of the magnet rollers MR1 through MR9 was inclined to 5° and 10°, and images were formed in the same manner as in the previous experiments. FIG. 16 shows the results of estimation as to a single dot, horizontal line and the omission of a trailing edge. The density (ID) of a black solid portion (so-called black solid ID) was also measured in each image. As FIG. 16 indicates, by inclining the main pole toward the upstream side in the direction of movement of the drum 1, it is possible to reduce the difference between horizontal and vertical lines and the omission of a trailing edge. This is also true with the magnet rollers MR1 through MR6 having greater half center angles. However, such an inclination of the main pole tends to lower the black solid ID, i.e., developing ability and is therefore undesirable from the efficient development standpoint. It is therefore most desirable to use a magnet roller having a small center angle (about 20°) and to provide the main pole with the angle of 0°, i.e., to align the developing magnetic pole with the closest point.

Assume the diameter of the developing sleeve 13, the diameter of the drum 1 and the characteristic of the developer particular to the illustrative embodiment. Then, the experiments described above proved that a desirable image free from the difference between horizontal and vertical lines and the omission of a trailing edge was achieved if the magnet brush parts from the drum 1 at a point about 1.5 mm downstream of the closest point. On the other hand, the thinning of a horizontal line and the omission of a trailing edge occurred if the magnet brush remained in contact with the drum 1 even at a point downstream of the above point.

The above-described phenomena derived the following findings. First, to obviate the thinning of a horizontal line and the omission of a trailing edge, it is necessary that the magnet brush ends contacting the drum 1 in a region where the developing sleeve 13 is close to the drum 1 to a certain degree. For example, in FIG. 15, only the magnet rollers MR8 and MR9 do not bring about the above undesirable occurrences when the angle of the main pole is 0°. By contrast, in FIG. 16, as the angle of the main pole is inclined toward the upstream side, even a magnet roller with a broad nip width does not bring above the undesirable occurrences. This suggests that the prerequisite is that the magnet brush and drum 1 end contacting each other in a region where they are close to each other to a certain degree. While the magnet brush MR7 has the same half center angle as the magnet rollers MR8 and MR9, i.e., 20°, the former has a higher main pole peak than the latter. The magnet roller MR7 therefore increases the size of the magnet brush, compared to the magnet rollers MR8 and MR9. More specifically, as shown in FIG. 14, the magnet roller MR7 slightly increases the height and width of the magnet brush. This is why the magnet brush falls or collapses in "a range where the electric field for development is capable of separating the toner and carrier", making the magnet roller MR7 unfeasible.

Figures 17A, 17B, 17C:
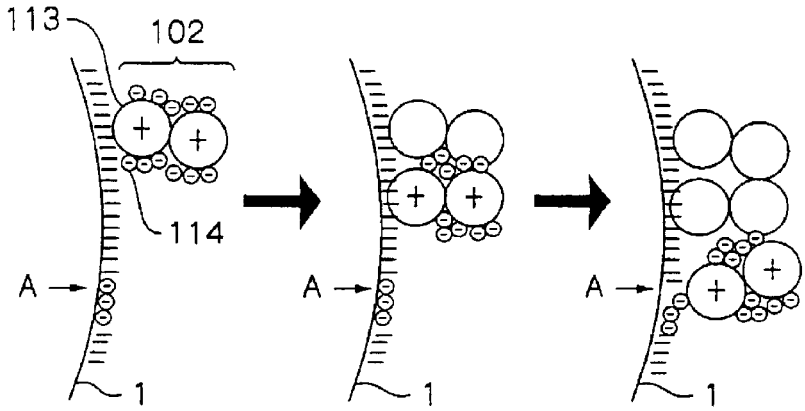
FIG. 17 is a view showing a region around a point where a photoconductive element and a developing sleeve are closest to each other.

FIG. 17 models the thinning of a horizontal line and the omission of a trailing edge in order to account for the propriety of the above condition. In FIG. 17, (a) through (c) each show a region around the closest point between the drum 1 and the developing sleeve 13. A magnet brush 602 is formed by toner particles 114 deposited on magnetic carrier particles 113. As shown in FIG. 17, (a), just after a horizontal line has been developed on the drum 1, toner developed the horizontal line exists on the drum 1 at the downstream side. In this condition, a single magnet brush (magnetic carrier) formed on the developing sleeve 3 approaches the drum 1. While the drum 1, in practice, rotates clockwise as viewed in FIG. 17, the magnet brush 602 passes the drum 1 because the peripheral speed of the developing sleeve 13 is two times as high as the peripheral speed of the drum 1. For this reason, the drum 1 is shown as being stationary in FIGS. 17, (a) through (c), for the simplicity of modeling.

In FIGS. 7, (a) and (b), the magnet brush approaching the drum 1 passes background portion where the drum 1 is negatively charged, before reaching the toner deposited on the horizontal line. As a result, the toner 114 moves away from the drum 1 toward the developing sleeve 13 little by little due to repulsion acting between the negative charges. Consequently, as shown in FIG. 17, (c), when the magnet brush 602 arrives at the trailing edge A of the horizontal line, the magnet brush 602 close to the drum 1 has its positively charged carrier particles practically bared. If adhesion acting between the toner and the drum 1 is weak, then the above magnet brush brought into contact with the horizontal line again absorbs the toner away from the drum 1 due to the positively charged carrier particles. This presumably is the mechanism that thins the horizontal line. The omission of a trailing edge can be accounted for by the same mechanism because toner deposits even on the portion of the drum 1 downstream of the horizontal line.

The question is which range the "region where the developing sleeve 13 and drum 1 are closed to each other to a certain degree" refers to. If the model described with reference to FIG. 7 is correct, the above region is one in which adhesion acting between the toner and drum 1 is intense enough to prevent the toner from again depositing on the magnet brush. Stated another way, the region in question is one in which adhesion between the carrier and the toner is weaker than adhesion between the toner and the drum 1. More specifically, the region is presumably one in which the electric field for development can separate the toner from the carrier. In such a region or range, the toner is prevented from again depositing on the carrier or, even if it again deposits on the carrier, the toner existing in the magnet brush can make up for the deposition.

Figure 18:
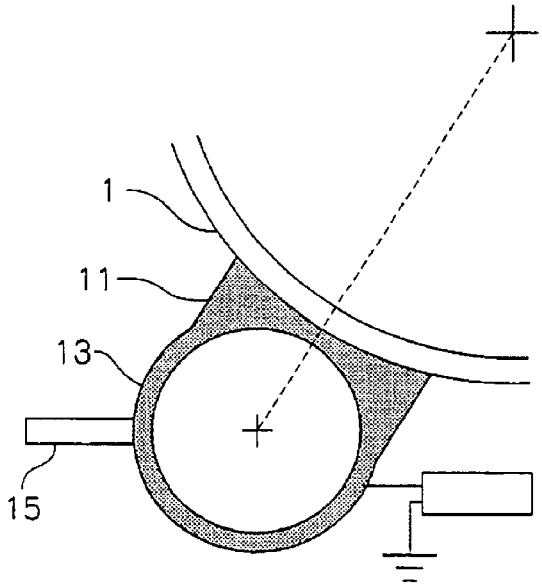
FIG. 18 is a view showing a configuration for specifying a range in which an electric field for development can separate toner and carrier from each other.

In accordance with the present invention, the "region in which the electric field for development can separate the toner from the carrier" was determined by the following method. The following experiment was conducted with an image forming apparatus identical in configuration with the illustrative embodiment, i.e., including a developing sleeve having a diameter of 20 mm, a drum having a diameter of 60 mm, a gap for development Gp of 0.4 mm, and a toner content of 5 wt %. As shown in FIG. 18, the developer 11 is held between the developing sleeve 13 and the drum 1 in a sufficient amount such that it fills the portion where the sleeve 13 and drum 1 face each other. This condition, in practice, does not occur during image formation. In this case, the magnet roller is absent in the developing sleeve 13 because it would disturb the subsequence steps with a magnet brush. Subsequently, a bias of −600 V is applied to the developing sleeve 13, as in the illustrative embodiment, without the drum 1 being rotated. At this instant, the potential of the drum 1 is selected to be the same as the potential of a black solid portion (−100 V in the illustrative embodiment). When the drum 1 is pulled out with the bias being continuously applied, toner contained in the developer exists on the portion of the drum 1 having faced the developing sleeve 13. This part of the toner is the toner separated from the carrier by the electric field for development.

Figures 19, 20:
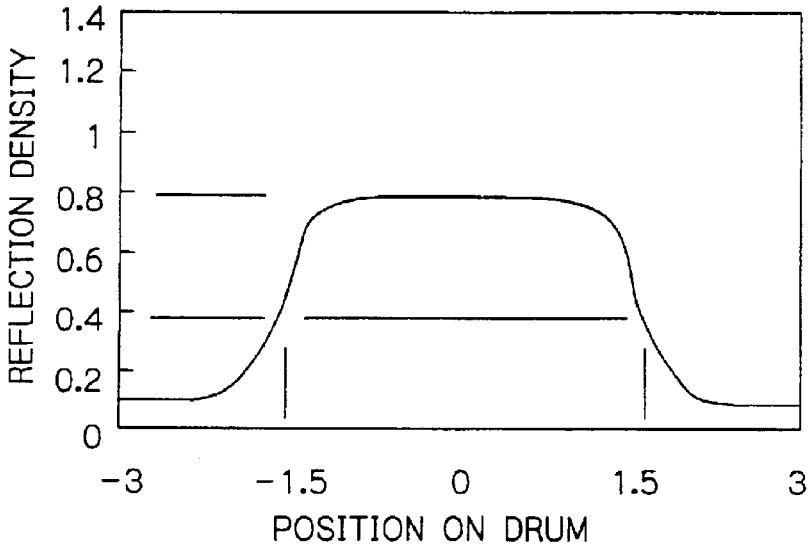
FIG. 19 is a graph showing the density distribution of a toner image on a photoconductive element determined by measurement.
FIG. 20 is a table showing a relation between the mean carrier particle sizes and the mean toner particle sizes of developers 1 through 3 and the IDs of solid images.

Subsequently, the toner deposited on the drum 1 is transferred to an adhesive tape NITTO PRINTAC available from Nitto Chemical Industry Co., Ltd. The adhesive tape is then adhered to a white paper sheet RICOH TYPE 6200 available from RICOH CO. LTD. The density of the image transferred to the white paper sheet is measured in the circumferential direction of the drum 1 by use of a microphotometer MPM-2 available from UNION OPTICAL CO., LTD. The micrometer MPM-2 has a main aperture of 5 $\mu$m, a subaperture of 250 $\mu$m, and a sampling pitch of 5 $\mu$m. FIG. 19 shows a density distribution measured by the above method; the abscissa and ordinate respectively indicate the circumferential distance on the drum 1 (the origin corresponds to the closest point) and the density at the distance. As FIG. 19 indicates, the density is high at the center portion and sequentially falls as the distance from the center portion increases. At this instant, it is noteworthy that positions where the density sharply falls exist. These positions are the boundaries delimiting the "region in which the electric field for development can separate the toner from the carrier". Assume a half width in which the density of the toner image on the drum 1 is higher than 0.5 times the peak value. Then, because the density sharply falls, it is possible to substantially specify the half width. In FIG. 19, the half width is 3.2 mm as the result of measurement indicates. Therefore, the "region in which the electric field for development can separate the toner from the carrier" extends over 3.2 mm. However, this region is not always 3.2 mm due to the diameter of the developing sleeve 13, the diameter of the drum 1, the gap for development, and the dielectric constant of the developer. In such a case, the above particular region is specified each time by the method described with reference to FIG. 18.

The fact that the above-described region in question exists within the nip width of 3.2 mm is coincident with the result shown in FIG. 15, i.e., the finding that the nip width of 3.1 mm obviates the thinning of a horizontal line and the omission of a tailing edge, but the width of 3.5 mm brings about such occurrences. The coincident proves the propriety of the model shown in FIG. 17.

It will be seen from the above that the thinning of a horizontal line and the omission of a trailing edge do not occur if the magnet brush ends contacting the drum 1 in the "region in which the electric field for development can separate the toner from the carrier". Next, a condition implementing a sufficient solid ID can be derived from FIG. 16. As FIG. 16 indicates, as the angle of the main pole is shifted more to the upstream side, i.e., as the distance between the developing sleeve 13 and the drum 1 increases in the region where the magnet brush rises, the black solid ID decreases, i.e., the toner fails to deposit on the drum 1 in a sufficient amount. This can be presumably accounted for, as follows. After the magnet brush has been fully formed on the developing sleeve 13, the carrier does not move dynamically, slowing down the movement of the toner. In this condition, only the toner existing at the surface of the magnet brush contributes to development. Stated another way, the toner around the base portion of the magnet brush makes no contribution to development, preventing a sufficient black solid ID from being achieved. This phenomenon presumably becomes more prominent as the length of the magnet brush increases. Presumably, to solve this problem, the magnet brush should start rising in the region where the developing sleeve 13 and drum 1 are close to each other to a certain degree, causing the developer, including the carrier, to move dynamically. This is supported by the results of the following experiments. FIG. 20 lists a relation between the mean carrier particle size, the mean toner particle size and the black solid ID determined by replacing the developer in the system of the illustrative embodiment.

FIG. 20 shows that developers 1 and 2 implement a desirable black solid ID while a developer 3 implements an acceptable solid ID. Assume that the mean carrier particle size and mean toner particle size are A and B, respectively, and that the characteristic value of a developer is expressed as C=A/B. Then, the values C of the developers 1, 2 and 3 are 10, 7 and 6, respectively. In this manner, the solid ID increases with an increase in the value C. This is presumably because when the toner particles are sufficiently smaller than the carrier particles, the toner particles easily move between the carrier particles. As a result, a large amount of toner moves due to the dynamic movement of the developer (carrier) and reaches the drum 1. While the developers 1 through 3 shown in FIG. 20 all implement sufficient black solid IDs, the values C above 7 are especially desirable because they saturate the black solid ID and maximize the developing ability. Such a characteristic of the developer is considered to prove the propriety of the assumption that a sufficient black solid ID is not achievable unless the developer rises.

The next question is a region in which the magnet brush, including the carrier, should start rising and move dynamically. The above description suggests that such a region is one in which a bias of a degree that allows the toner, which is freely movable due to the dynamic movement of the magnet brush, to start moving toward an image portion with a certain degree of activeness acts. Although the region in which the above bias acts cannot be easily specified, it may safely be said that the toner moves toward an image portion extremely actively in a region where the electric field for development is at least intense enough to separate the toner from the carrier. This region is therefore coincident with at least the previously stated region where the electric field can separate the toner from the carrier. The above region can therefore be specified by the method described with reference to FIGS. 18 and 19.

It will be seen from the above that a sufficient black solid ID is achievable at least if the magnet brush rises in the region where the electric field for development is intense enough to separate the toner from the carrier. Also, a sufficient black solid ID is achievable without the thinning of a horizontal line or the omission of a trailing edge at least if the magnet brush rises, contacts the drum 1 and parts from the drum 1 within the range where the electric field is capable of separating the toner from the carrier. Actually, in the case of a developing device of the type holding a developer in contact with a drum over an effective developing region, it is well known that only an image with a low black solid ID is output if the distance between a developing sleeve and the drum is simply increased. As for the width of the magnet brush, a sufficient black solid ID is attained not only if the width is smaller than the width of the effective developing region, but also if the magnet brush rises within the effective developing region. In addition, the thinning of a horizontal line and the omission of a trailing edge are obviated if the above two conditions are satisfied. It is noteworthy that the auxiliary poles adjoining the main pole in the illustrative embodiment reduce the half center angle and activate the movement of the developer when the developer rises due to the switching of the magnetic field, compared to a single pole.

Second Embodiment

Figure 21:
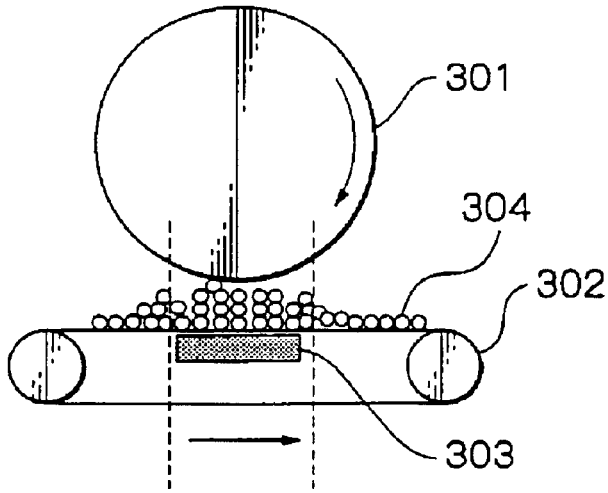
FIG. 21 is a view showing a developing region representative of a second embodiment of the present invention.

Reference will be made to FIG. 21 for describing an alternative embodiment of the present invention. As shown, in the illustrative embodiment, the developer carrier is implemented as an endless belt 302. A photoconductive drum 301 is identical with the drum 1 of the previous embodiment. A developer 304 made up of toner and magnetic carrier is deposited on the belt 302. A magnetic pole 303 forms a magnetic field in the vicinity of the closest point where the belt 302 and drum 301 are closest to each other. The developer 304 on the belt 302 rises due to the action of the above magnetic field, forming a magnet brush. The magnet brush rubs itself against the drum 301 so as to develop a latent image formed on the drum 301. The intermediate region of a range delimited by two dotted lines is the region where the electric field for development can separate the toner from the carrier. This region can be determined in the same manner as described with reference to FIG. 19. The developer 304 risen in the above particular region, rubbed itself against the drum 1 and then fallen, or collapsed, drops from the left end of the belt 302, as viewed in FIG. 21, and again brought to the right end of the belt 302 by a circulation mechanism, not shown, so as to be reused for development.

In the illustrative embodiment, the belt 302 parts from the drum 1 more slowly than the developing sleeve 13 and therefore implements a broader region where the electric field for development can separate the toner form the carrier. This allows even the conventional magnet having a broad half center angle to be used, i.e., makes it needless to use the magnet roller of the previous embodiment including the auxiliary poles.

Third Embodiment

Figure 22:
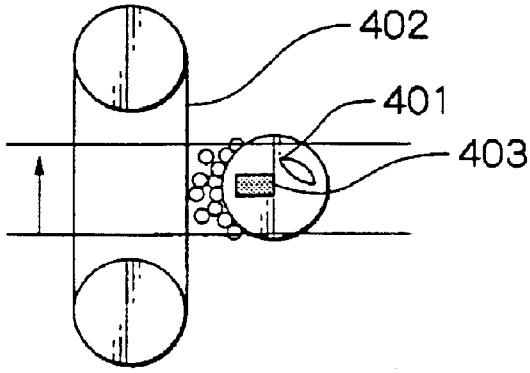
FIG. 22 is a view showing a developing region representative of a third embodiment of the present invention.

Referring to FIG. 22, a third embodiment of the present invention will be described. This embodiment also uses the developer described in relation to the first embodiment. A developing sleeve or developer carrier 401 is identical with the developing sleeve 13 of the first embodiment except that it does not include the auxiliary poles. The developer made up of toner and carrier is deposited on the developing sleeve 401. A magnetic pole 403 forms a magnetic field in the vicinity of the closest point where the developing sleeve 401 is closest to a drum 402. The developer is caused to rise by the above electric field, forming a magnet brush. The magnet brush rubs itself against the drum 401 for thereby developing a latent image. Because the magnetic pole 403 does not include auxiliary poles, it has a broader half center angle than in the first embodiment. However, the belt 402 parts form the drum 401 as slowly as in the second embodiment. Again, a broad region delimited by two dotted lines in FIG. 22 is the region where the electric field for development can separate the toner from the carrier. The developer therefor rises in the above range, rubs itself against the drum 401 and then falls without resorting to auxiliary poles.

Fourth Embodiment

Figure 23:
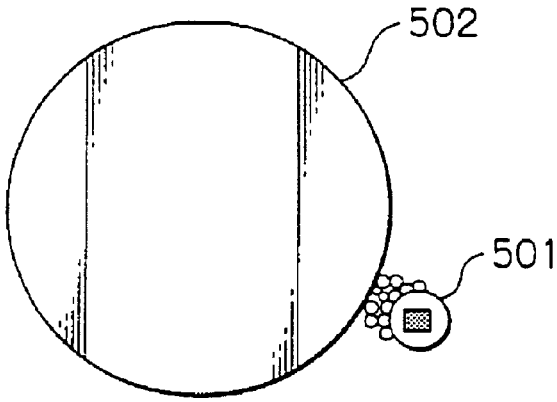
FIG. 23 is a view showing a developing region representative of a fourth embodiment of the present invention.

FIG. 23 shows a fourth embodiment of the present invention. As shown, this embodiment includes a developing sleeve 501 having a relatively small diameter of 20 mm to 10 mm. The developing sleeve 501 with such a small diameter may lack a space for arranging the auxiliary poles at both sides of the main pole as in the first embodiment. In such a case, a single auxiliary pole may be positioned at either side of the main pole. Alternatively, use may be made of a thin magnet (sintered magnet) having only a main pole, but exhibiting great self-magnetization. This kind of magnet reduces the half center angle and also allows the magnet brush to rise in the previously stated particular range and then fall.

Fifth Embodiment

The thinning of a horizontal line and the omission of a trailing edge occur little if the background potential is lower than 100 V, as indicated by triangles in FIG. 15. However, a lower background potential is apt to bring about background contamination. Background contamination does not depend on the half center value or the main pole angle of the magnet roller, but depends on background potential.

FIG. 24 shows the degrees of background contamination estimated with the magnet roller MR8 by varying the background potential in the range of from 50 V to 300 V. The estimation was conducted at room temperature of 22° C. and humidity of 10% (normal temperature and humidity environment) and at room temperature of 30° C. and humidity of 90% (high temperature and humidity environment). Circles indicate background contamination satisfactory in both of the two environments. Triangles indicate background contamination satisfactory only in the normal temperature and humidity environment. Further, crosses indicate background contamination short in both of the two environments.

As FIG. 24 indicates, if the background potential is 100 V or above, background contamination occurs little in both of the normal temperature and humidity environment and high temperature and humidity environment. This is compatible with the obviation of the thinning of a horizontal line and the omission of a trailing edge.

Sixth Embodiment

Assume that the developing sleeve 13 and the drum 1 are spaced from each other by a distance Gp, and that the sleeve 13 and the doctor blade 15 are spaced from each other by a distance Gd. Then, a sixth embodiment of the present invention, which uses the magnet roller MR8 like the first embodiment, considers a range of Gd/Gp between 0.8 and 1.0. While the distance Gp was fixed at 0.4 mm, the distance Gd was selected to be 0.4 mm, 0.3 mm and 0.2 mm so as to measure the height of the magnet brush by the previously stated method. FIG. 25 lists the range of the center angle θ of the magnet roller MR8 at which the magnet brush formed thereon contacts the drum 1 around the closest point. Because the main pole angles of the magnet rollers were 0° without exception, the main poles were aligned with the closest point. As shown in FIG. 25, as the distance Gd is reduced, the amount of developer to be conveyed by the developing sleeve 13 decreases and reduces the height of the magnet brush between the magnetic poles. As a result, the range over which the magnet brush contacts the drum 1 around the closest point slightly decreases. FIG. 25 shows the results of estimation of image quality also.

Because the illustrative embodiment uses the magnet roller MR8, the results of estimation as to the difference between horizontal and vertical lines and the omission of a trailing edge are good (circles) in all conditions. However, a decrease in the distance Gd lowers the density of the magnet brush at the closest point and thereby renders solitary dots irregular in size. Consequently, reproducibility is deteriorated in, e.g., a high contrast portion (see FIG. 25, fifth column; observation by eye). Further, a decrease in the distance Gd lowers the developing ability as well (see FIG. 25, sixth column; observation by eye). It follows that the ratio Gd/Gp is about 1 to 0.8 and should preferably be as close to 1 as possible. The experiments were conducted on the assumption that the distance Gd and the height of the developer passed the doctor blade 15 (with the magnet brush collapsed) were substantially the same as each other. In practice, however, the height of the developer passed the doctor blade 15 depends on the flux density at the position where the blade 15 faces the developing sleeve 13 and the material of the blade 15, which may be magnetic. The doctor blade 15 is therefore considered to adjust the height of the developer to the value Gd.

While the distance Gp is selected to be 0.4 mm in the illustrative embodiment, it may have any other suitable value. The distance Gp would deteriorate the developing ability and aggravate the edge effect if excessively great or would render development susceptible to the oscillation of the developing sleeve 13 and drum 1 and would thereby require strict mechanical accuracy if excessively small. In this respect, the distance Gp should preferably range from about 0.8 mm to about 0.2 mm.

By confining the ratio Gp/Gd in the range of from 0.8 to 1.0, it is possible to improve the thinning of a horizontal line and the omission of a trailing edge and to improve the reproduction of tonality in a highlight portion and free a medium density portion from granularity at the same time.

Seventh Embodiment

A seventh embodiment is identical with the first embodiment, which uses the magnet roller MR8, except that the magnet carrier has a saturation magnetization ranging from 40 emu/g to 80 emu/g. FIG. 26 shows the results of estimation made under such conditions as to a single dot, horizontal line and the omission of a trailing edge.

When the saturation magnetization is lowered, the height of the magnet brush decreases and increases margins as to the thinning of a horizontal line and the omission of a trailing edge, but so-called carrier deposition is apt to occur. Conversely, when the saturation magnetization is raised, the magnet brush grows higher and becomes hard and therefore reduces the above margins. As FIG. 26 indicates, if the magnetic carrier has a saturation magnetization ranging from 40 emu/g to 80 emu/g, carrier deposition is obviated. The height of the magnet brush is susceptible not only to the saturation magnetization of the magnetic carrier but also to the magnetic field formed by the magnet roller. The saturation magnetization may therefore have any value within the range of from 40 emu/g to 80 emu/g.

The above range of saturation magnetization of the magnetic carrier successfully improves the thinning of a horizontal line and the omission of a trailing edge and obviates carrier deposition.

Eighth Embodiment

An eighth embodiment is identical with the first embodiment, which uses the magnet roller MR8, except that the developing sleeve 13 moves at a speed higher than the moving speed of the drum 1. So long as the moving speed of the developing sleeve 13 is equal to the moving speed of the drum 1, the thinning of a horizontal line and the omission of a trailing edge do not occur. In this case, however, the amount of toner to be conveyed to the developing region decreases and lowers the developing ability, i.e., reduces the black solid ID. Further, lines and solitary dots are disfigured and cannot be stably reproduced. Moreover, because the magnet brush does not rub itself against the drum 1, the toner deposited on the background of the drum 1 cannot be scraped off by a mirror force, aggravating background contamination. In the illustrative embodiment, the developing sleeve 13 is caused to move at a higher speed than the drum 1, preferably 1.5 to 2.5 times higher speed than the drum 1.

By moving the developing sleeve at the above-described speed, it is possible to improve the thinning of a horizontal line and the omission of a trailing edge, to enhance the stable reproduction of lines and solitary dots, and to obviate background contamination, which occurs if the magnet brush does not contact the drum 1.

Ninth Embodiment

A ninth embodiment of the present invention differs from the first embodiment in that it applies an AC-biased DC voltage to the developing sleeve 13 in order to enhance the developing ability. Specifically, in the illustrative embodiment, the drum 1 is charged to −450 V while a DC component of −300 on which an AC component of 2 kV (peak-to-peak) is superposed is applied as a bias for development. The AC component has a rectangular wave and a frequency of 5 kHz. By improving the developing ability, it is possible to lower the charge potential required of the drum 1. If desired, the AC component has a sinusoidal wave, a triangular wave or an asymmetric wave. The AC-biased DC voltage improves the thinning of a horizontal line and the omission of a trailing edge and enhances the developing ability.

In summary, it will be seen that the present invention provides an image forming method and an apparatus therefor capable of obviating the thinning of a horizontal line and the omission of a trailing edge. This advantage is derived from a unique configuration that causes a magnet brush to rise and then fall in a developing region within a range in which an electric field formed between a photoconductive element and a developing sleeve is more intense than one capable of separating toner and carrier from each other. Further, if the magnet brush does not contact the photoconductive element in a range downstream of the above range in the direction of movement of the element, then it is not necessary to take account of the fall of the magnet brush. This allows the magnetic poles of a magnet roller to be relatively freely arranged and therefore increases tolerance on a production line.

Various modifications will become possible for those skilled in the art after receiving the teachings of the present disclosure without departing from the scope thereof.

What is claimed is:

1. An image forming method comprising the steps of:

providing a developer including a toner and a magnetic carrier, a developer carrier configured to convey said developer deposited thereon, and magnetic field generating means fixed within said developer carrier;

generating a magnetic field by said magnetic field generating means between an image carrier and said developer carrier in a limited range in which an electric field capable of separating said toner and said magnetic carrier from each other is formed, said limited range being defined by a center angle of said magnetic field generating means ranging between negative 9 degrees to positive 9 degrees; and forming a magnet brush in said magnetic field such that said magnet brush rises, contacts said image carrier, and collapses in the limited range in which the electric field capable of separating said toner and said magnetic carrier from each other is formed, wherein said magnet brush rubs said image carrier to thereby develop a latent image formed on said image carrier.

2. A method as claimed in claim 1, further comprising the steps of:

providing auxiliary magnetic field generating means for generating a second magnetic field; and generating the second magnetic field at a downstream side of said magnetic field generating means in a direction of conveyance of the developer for thereby releasing said magnet brush from said image carrier within said range.

3. A method as claimed in claim 1, further comprising the steps of:

providing auxiliary magnetic field generating means for generating a second magnetic field; and generating the second magnetic field at an upstream side of said magnetic field generating means in a direction of conveyance of the developer for thereby activating a movement of the developer in said range.

4. A method as claimed in claim 3, further comprising the steps of:

providing second auxiliary magnetic field generating means for generating a third magnetic field; and generating the third magnetic field at a downstream side of said magnetic field generating means in a direction of conveyance of the developer for thereby releasing said magnet brush from said image carrier within said range.

5. A method as claimed in claim 1, further comprising reducing a half center angle of a main pole of the magnetic field formed by said magnetic field generating means to thereby form the magnetic field that causes the magnet brush to rise, contact the image carrier and then fall.

6. A method as claimed in claim 5, further comprising the steps of:

providing auxiliary magnetic field generating means for generating a second magnetic field; and generating the second magnetic field at a downstream side of said magnetic field generating means in a direction of conveyance of the developer for thereby releasing said magnet brush from said image carrier within said range.

7. A method as claimed in claim 5, further comprising the steps of:

providing auxiliary magnetic field generating means for generating a second magnetic field; and generating the second magnetic field at an upstream side of said magnetic field generating means in a direction of conveyance of the developer for thereby activating a movement of the developer in said range.

8. A method as claimed in claim 7, further comprising the steps of:

providing second auxiliary magnetic field generating means for generating a third magnetic field; and generating the third magnetic field at downstream side of said magnetic field generating means in a direction of conveyance of the developer for thereby releasing said magnet brush from said image carrier within said range.

9. A method as claimed in claim 1, wherein said magnetic field generating means comprises a single magnetic pole.

10. A method as claimed in claim 1, wherein the forming further comprises forming a magnetic brush in said magnetic field having a half center angle of a main pole thereof ranging between 20 degrees to 50 degrees.

11. A method as claimed in claim 1, wherein the forming further comprises forming a magnetic brush in said magnetic field having a half center angle of a main pole thereof of 20 degrees.

12. A method as claimed in claim 1, wherein the forming further comprises forming a magnetic brush in said magnetic field having a half center angle of a main pole thereof of 35 degrees.

13. A method as claimed in claim 1, wherein the forming further comprises forming a magnetic brush in said magnetic field having a half center angle of a main pole thereof of 50 degrees.

14. An image forming apparatus comprising:

an image carrier;

a developer carrier configured to convey a developer including a toner and a magnetic carrier deposited thereon; and magnetic field generating means for generating a magnetic field between said image carrier and said developer carrier in a limited range in which an electric field capable of separating said toner and said magnetic carrier from each other is formed, said limited range being defined by a center angle of said magnetic field generating means ranging between negative 9 degrees to positive 9 degrees, wherein a magnet brush is formed in said magnetic field such that said magnet brush rises, contacts said image carrier, and collapses in the limited range in which the electric field capable of separating said toner and said magnetic carrier from each other is formed, and wherein said magnet brush rubs said image carrier for thereby developing a latent image formed on said image carrier.

15. An apparatus as claimed in claim 14, further comprising auxiliary magnetic field generating means for generating a second magnetic field in an upstream side of said magnetic field generating means in a direction of conveyance of the developer at a position within said range where a boundary between said auxiliary magnetic field generating means and said magnetic field generating means exists.

16. An apparatus as claimed in claim 15, further comprising second auxiliary magnetic field generating means for generating a third magnetic field in a downstream side of said magnetic field generating means in a direction of conveyance of the developer at a position within said range where a boundary between said second auxiliary magnetic field generating means and said magnetic field generating means exists.

17. An apparatus as claimed in claim 14, wherein said magnetic field generating means comprises a single magnetic pole.

18. An apparatus as claimed in claim 14, wherein said magnetic field has a half center angle of a main pole thereof ranging between 20 degrees to 50 degrees.

19. An apparatus as claimed in claim 14, wherein said magnetic field has a half center angle of a main pole thereof of 20 degrees.

20. An apparatus as claimed in claim 14, wherein said magnetic field has a half center angle of a main pole thereof of 35 degrees.

21. An apparatus as claimed in claim 14, wherein said magnetic field has a half center angle of a main pole thereof of 50 degrees.

22. An image forming apparatus comprising:

an image carrier;

a developer carrier configured to convey a developer including a toner and a magnetic carrier deposited thereon; and a magnetic field generating device fixed within said developer carrier and configured to generate a magnetic field between said image carrier and said developer carrier in a limited range in which said magnetic field is more intense than an electric field capable of separating said toner and said carrier from each other is formed, said limited range being defined by a center angle of said magnetic field generating means ranging between negative 9 degrees to positive 9 degrees, wherein a magnet brush is formed in said magnetic field such that said magnet brush rises, contacts said image carrier, and collapses in the limited range in which said magnetic field is more intense than the electric field capable of separating said toner and said carrier from each other is formed, and wherein said magnet brush rubs said image carrier for thereby developing a latent image formed on said image carrier.

23. An apparatus as claimed in claim 22, further comprising an auxiliary magnetic field generating device configured to generate a second magnetic field and positioned at an upstream side of said magnetic field generating device in a direction of conveyance of the developer at a position within said range where a boundary between said auxiliary magnetic field generating device and said magnetic field generating device exists.

24. An apparatus as claimed in claim 23, further comprising a second auxiliary magnetic field generating device configured to generate a third magnetic field and positioned at a downstream side of said magnetic field generating device in a direction of conveyance of the developer at a position within said range where a boundary between said second auxiliary magnetic field generating device and said magnetic field generating device exists.

25. An apparatus as claimed in claim 22, wherein said magnetic field generating device comprises a single magnetic pole.

26. An apparatus as claimed in claim 22, wherein said magnetic field has a half center angle of a main pole thereof ranging between 20 degrees to 50 degrees.

27. An apparatus as claimed in claim 22, wherein said magnetic field has a half center angle of a main pole thereof of 20 degrees.

28. An apparatus as claimed in claim 22, wherein said magnetic field has a half center angle of a main pole thereof of 35 degrees.

29. An apparatus as claimed in claim 22, wherein said magnetic field has a half center angle of a main pole thereof of 50 degrees.

* * * * *